US006422831B1

(12) United States Patent
Ito et al.

(10) Patent No.: US 6,422,831 B1
(45) Date of Patent: Jul. 23, 2002

(54) VARIABLE DISPLACEMENT PISTON PUMP/MOTOR

(75) Inventors: Takao Ito; Hisanobu Kanamaru, both of Sagamihara (JP)

(73) Assignee: Aida Engineering Co., Ltd., Kanagawa (JP)

( * ) Notice: Subject to any disclaimer, the term of this patent is extended or adjusted under 35 U.S.C. 154(b) by 48 days.

(21) Appl. No.: 09/686,717

(22) Filed: Oct. 10, 2000

(30) Foreign Application Priority Data

Oct. 12, 1999 (JP) ..... 11-288909

(51) Int. Cl.[7] ..... F04B 1/12; F04B 27/08

(52) U.S. Cl. ..... 417/269; 417/222.1

(58) Field of Search ..... 417/222.1, 269

(56) References Cited

U.S. PATENT DOCUMENTS

| | | | | | |
|---|---|---|---|---|---|
| 4,594,055 | A | * | 6/1986 | Hatakeyama et al. | 417/269 |
| 5,176,066 | A | * | 1/1993 | Kanamaru et al. | 91/499 |
| 5,415,077 | A | * | 5/1995 | Ono | 92/71 |
| 6,012,905 | A | * | 1/2000 | Takashima et al. | 417/222.1 |
| 6,012,906 | A | * | 1/2000 | Kanamaru | 417/269 |
| 6,092,996 | A | * | 7/2000 | Obrist et al. | 417/269 |

* cited by examiner

*Primary Examiner*—Charles G. Freay
*Assistant Examiner*—William Rodriguez
(74) *Attorney, Agent, or Firm*—Darby & Darby

(57) ABSTRACT

In a variable piston pump/motor, input/output shafts are pivotably supported by a housing via a shaft support cylinder formed with a spherical outer surface. The housing is disposed so that it can tilt in one direction, pivoting around hydraulic intake/discharge tubes fixed at a position along lines connecting spherical heads of pistons.

5 Claims, 5 Drawing Sheets

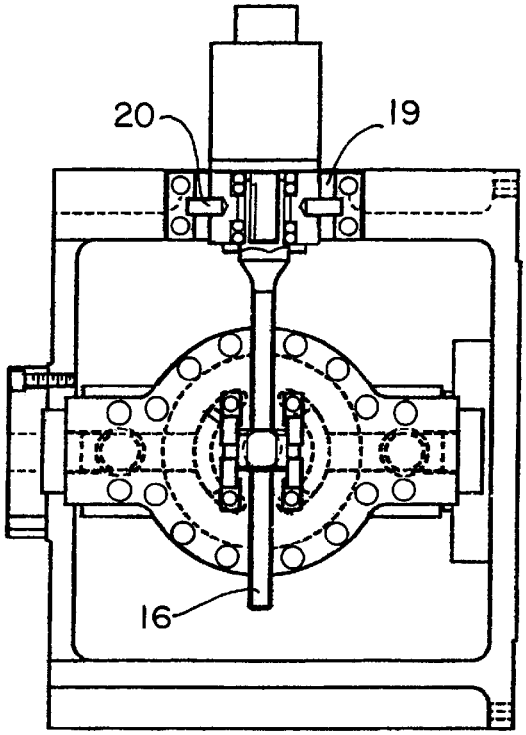
FIG. 5
FIG. 6
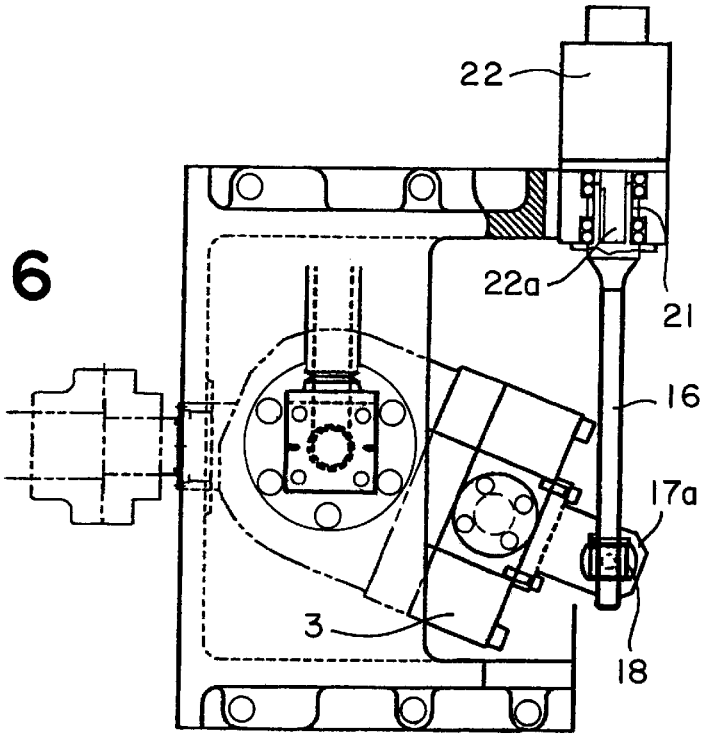

VARIABLE DISPLACEMENT PISTON PUMP/ MOTOR

BACKGROUND OF THE INVENTION

The present invention relates to a variable displacement piston pump/motor using optimal hydraulic pressure and acting as a drive source for hydropneumatic presses, hydraulic motors, or the like.

Japanese laid-open patent publication number 4-228924 and others disclose variable displacement piston/pump motors in which an input or output shaft angle (theta) is manipulated to control the discharge volume or the rotation output of a pump. Also, Japanese laid-open patent publication number 10-18962 discloses a variable displacement swash-plate hydraulic pump. In this technology, a manual traction lever is used to tilt the swash plate from a neutral, perpendicular position relative to the drive shaft to either the positive or the negative direction, thus controlling an axial piston, which makes a reciprocating motion inside a cylinder block.

In the former device, the angle (theta) of the shaft must be changed in order to change the discharge volume of the pump or the rotation speed of the pump motor. Thus, when a drive shaft serving as a rotating load on the shaft is connected directly, the housing is fixed, making it necessary for the shaft angle to be fixed. In other words, the output capacity and the rotation speed cannot be changed. If the shaft position were to be fixed and the housing were to be tilted, flexible, tightly sealed tubing must be used since the intake opening and the discharge opening are positioned axially. As a result, implementing this type of device becomes complex.

In the latter hydraulic pump, a drive shaft is passed through the swash plate, and this swash plate is tilted to control the discharge volume. Thus, a large tilting angle cannot be used, and even if a large angle were to be used, the size of the hydraulic pump would necessarily increase, making it unsuitable for compact, light-weight designs.

OBJECTS AND SUMMARY OF THE INVENTION

The object of the present invention is to provide a variable displacement piston pump/motor that is compact, that has a simple structure, and that can operate in a stable manner.

Another object of the present invention is to provide a variable displacement piston pump/motor that can be tilted with a small traction force.

Yet another object of the present invention is to provide a variable displacement piston pump/motor that allows a desired tilting angle to be reliably approached using a small drive force.

Yet another object of the present invention is to provide a variable displacement piston pump/motor that can easily be used in CNC (Computer Numerical Control).

In the present invention, it would be desirable for a shaft support cylinder to have a spherical outer perimeter surface and to have a spherical surface contact between this surface and one end of a housing.

In a variable displacement piston pump/motor according to the present invention, the variable displacement piston pump/motor is disposed in a cylindrical housing with one end covered by a side cover. The side cover includes: input/output shafts maintaining a fixed relationship; a cylinder block facing the shafts, another end of the cylinder block disposed on the side cover via a valve plate; a drive pin interposed between and connecting the cylinder block and the shafts; and a plurality of concentric piston devices disposed around the drive pin, providing rotation output or hydraulic discharge force, and including spherical heads pivotably supported by an end surface of the shaft. The input/output shafts are pivotably supported by another end of the housing via a shaft support cylinder formed with a spherical outer surface. The housing can be tilted freely in one direction, pivoting around hydraulic intake/discharge path-forming tubes fixed on lines connecting centers of the spherical heads of the pistons.

In the present invention, a traction lever attachment mechanism is disposed at an axis center section of an outer side surface of the side cover. Pulling the traction lever attachment mechanism in one direction applies a tilting angle to the housing.

Traction lever can be formed from a threaded shaft meshed with a pivot pin rotatably disposed on a plate fixed to the side cover. The traction lever is controlled by externally applied forward or reverse rotation.

In the present invention, a base of the threaded shaft can be rotatably supported by a boss that is pivotably supported by a pivot pin.

A servo motor can be used to apply rotation force to the threaded shaft.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 5 is a side-view drawing of another embodiment of the variable displacement piston pump/motor of the present invention.

FIG. 6 is a drawing showing the housing of the FIG. 5 embodiment in a tilted state.

DETAILED DESCRIPTION OF THE PREFERRED EMBODIMENTS

Figure 1:
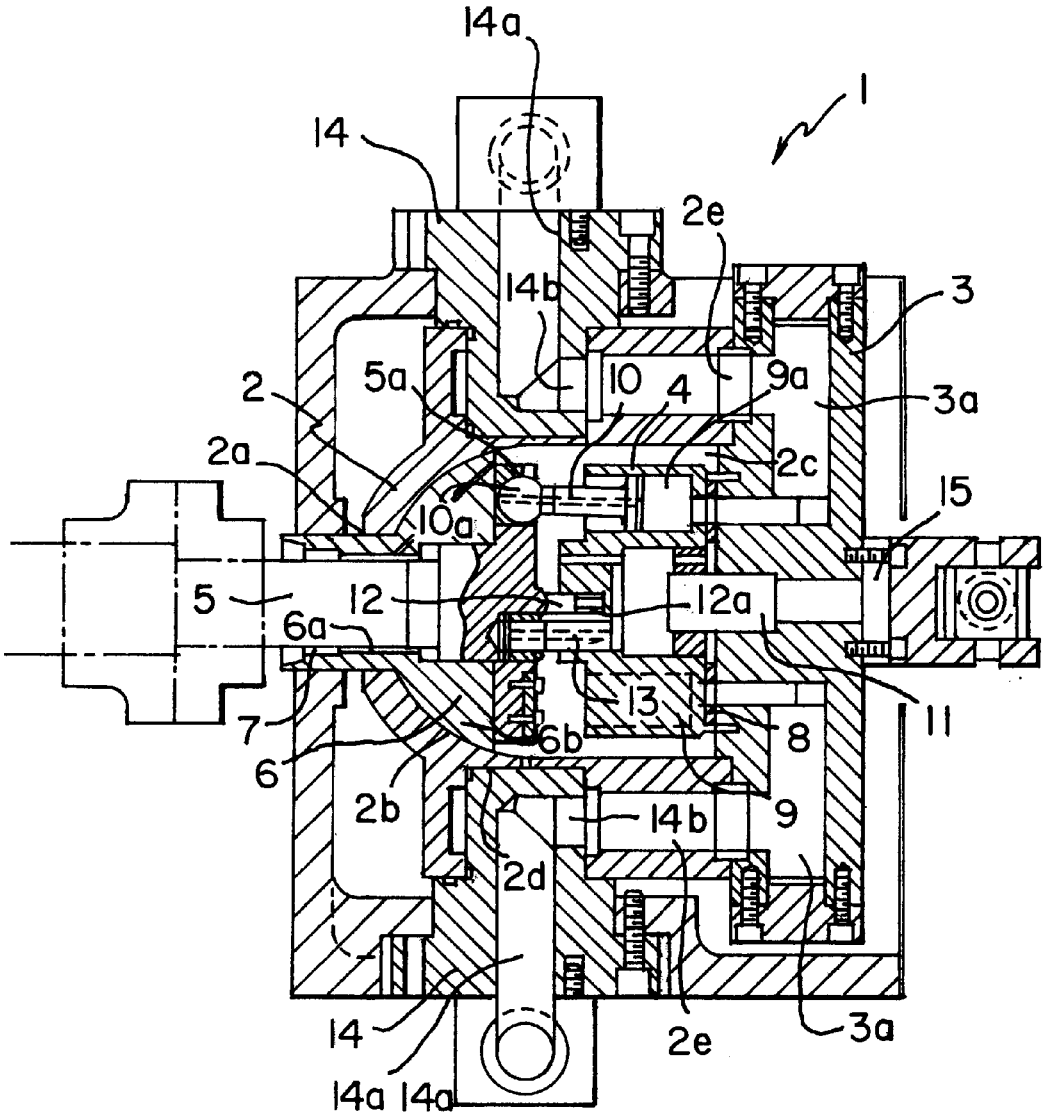
FIG. 1 is a schematic vertical cross-section drawing as seen from the front of a variable displacement piston pump/motor according to an embodiment of the present invention.
Figure 2:
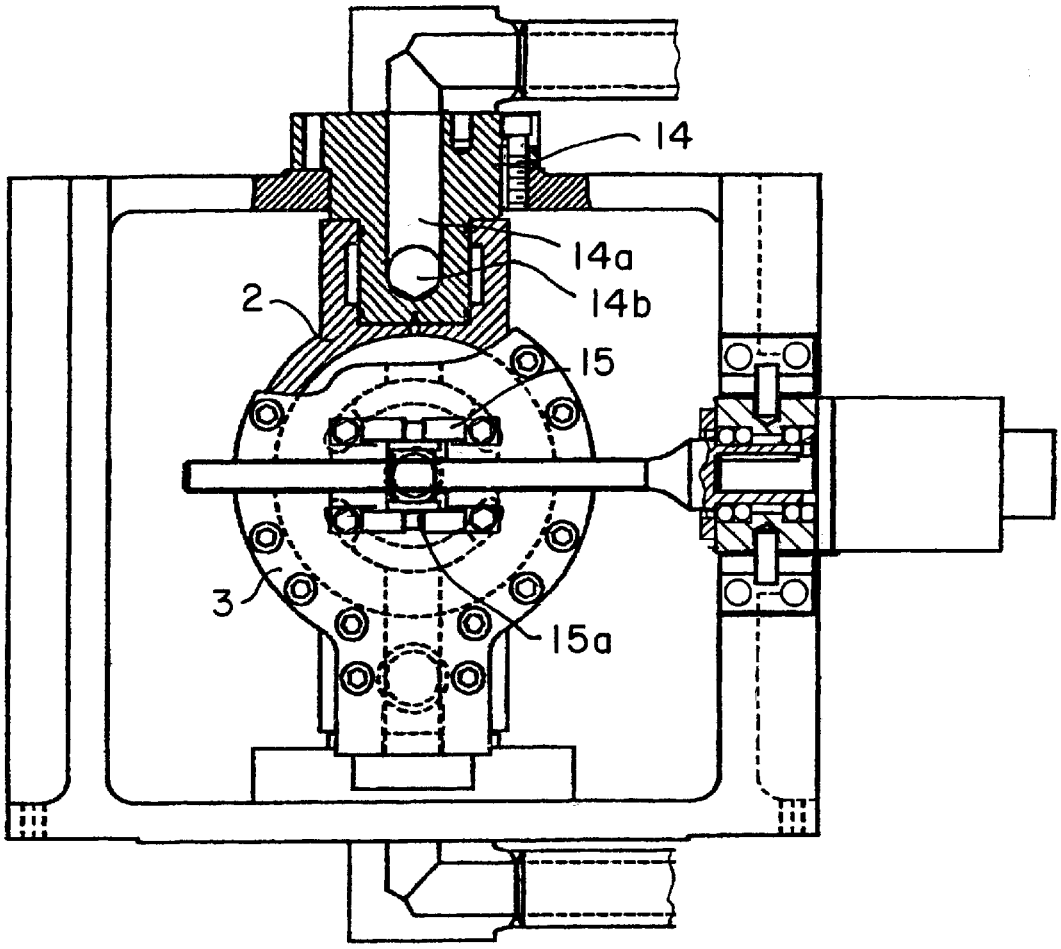
FIG. 2 is a schematic vertical view partly in section as seen from the right side in FIG. 1.

Referring to FIG. 1 through FIG. 6, the following is a description of a variable displacement piston pump/motor according to an embodiment of the present invention. Referring to FIG. 1 through FIG. 4, there is shown the overall structure of the device. In a pump/motor 1, an outer frame is formed from: a cylindrical housing 2 formed with an opening 2*a* at an end thereof and an inner perimeter surface 2*b* around the end shaped as a concave spherical surface; and a side cover 3 covering a rear opening end 2*c* of the housing 2. A piston/pump motor 4 is mounted internally in the pump/motor 1.

Input/output shafts 5 of the piston/pump motor 4 are formed with a roughly T-shaped cross-section. one end of which extends through the opening 2*a* of the housing 2 and is rotatably supported via a bearing 7 in a hollow section 6*a* of a shaft supporting cylinder 6, which forms a pivotable spherical surface contact with the end inner perimeter surface 2*b* of the housing 2. The front surface of an opposite end of the input/output shafts 5 forms a support section 5*a* of pistons 10 and is disposed facing a cylinder block 9 rotatably disposed on the inner side surface of the side cover 3 via a valve plate 8. The cylinder block 9 rotates around a center pin 11 and is kept pressed to the valve plate 8 by a pressing pin 12 on the other side and an expanding spring 12*a*.

The rear surface of the piston support section 5*a* abuts a side end surface 6*b* of the shaft support cylinder 6 so that axial displacement is restricted. A plurality (three) of drive pins 13 for transferring torque are disposed concentrically at equal intervals roughly near the midpoint between the piston support section 5*a* and the cylinder block 9. At the outer perimeter there is concentrically disposed a plurality (nine) of pistons 10. Spherical heads 10*a* are pivotably supported by piston supporting sections 5*a*, and opposite piston ends are slidably inserted in bores 9*a* of the cylinder block 9.

Cylindrical openings 2*d* are formed having one sealed end each on the upper and lower sections of the housing 2 along the lines connecting the centers of the spherical sections 10*a* of the pistons 10. The cylindrical openings 2*d* pivotably support and tightly seal hydraulic intake/discharge path tubes 14, in which are formed vertical and horizontal hydraulic intake/discharge paths 14*a*, 14*b*. A communicating path 2*e* is formed on the thick cylindrical section of the housing 2 to form a path with the hydraulic intake/discharge paths 14*b*. The communicating path 2*e* extends toward the side cover 3 and is connected to a communicating path 3*a* of the side cover 3, which is disposed to communicate with the bores 9*a* of the cylinder block 9.

Figure 3:
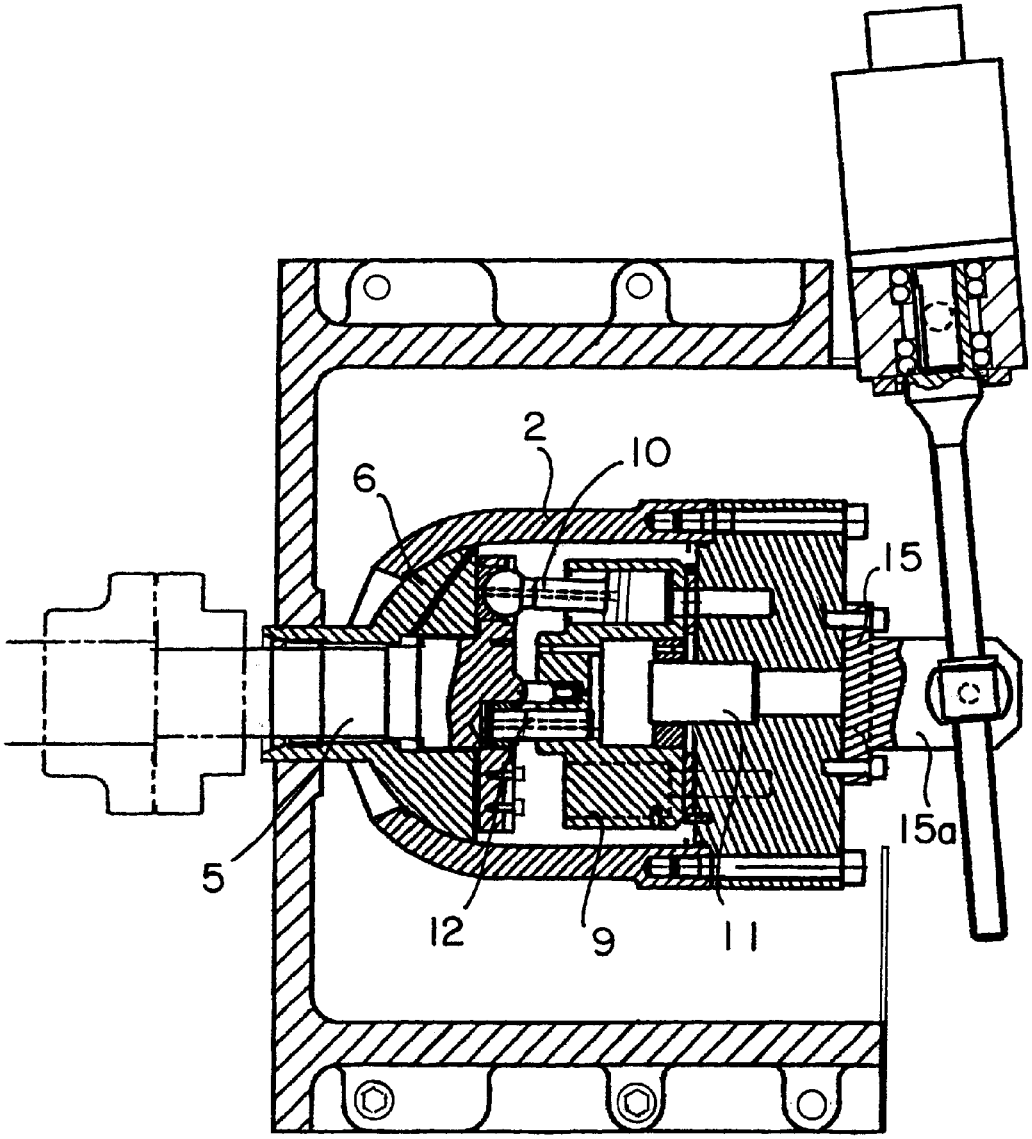
FIG. 3 is a schematic horizontal cross-section drawing as seen from above in FIG. 1.
Figure 4:
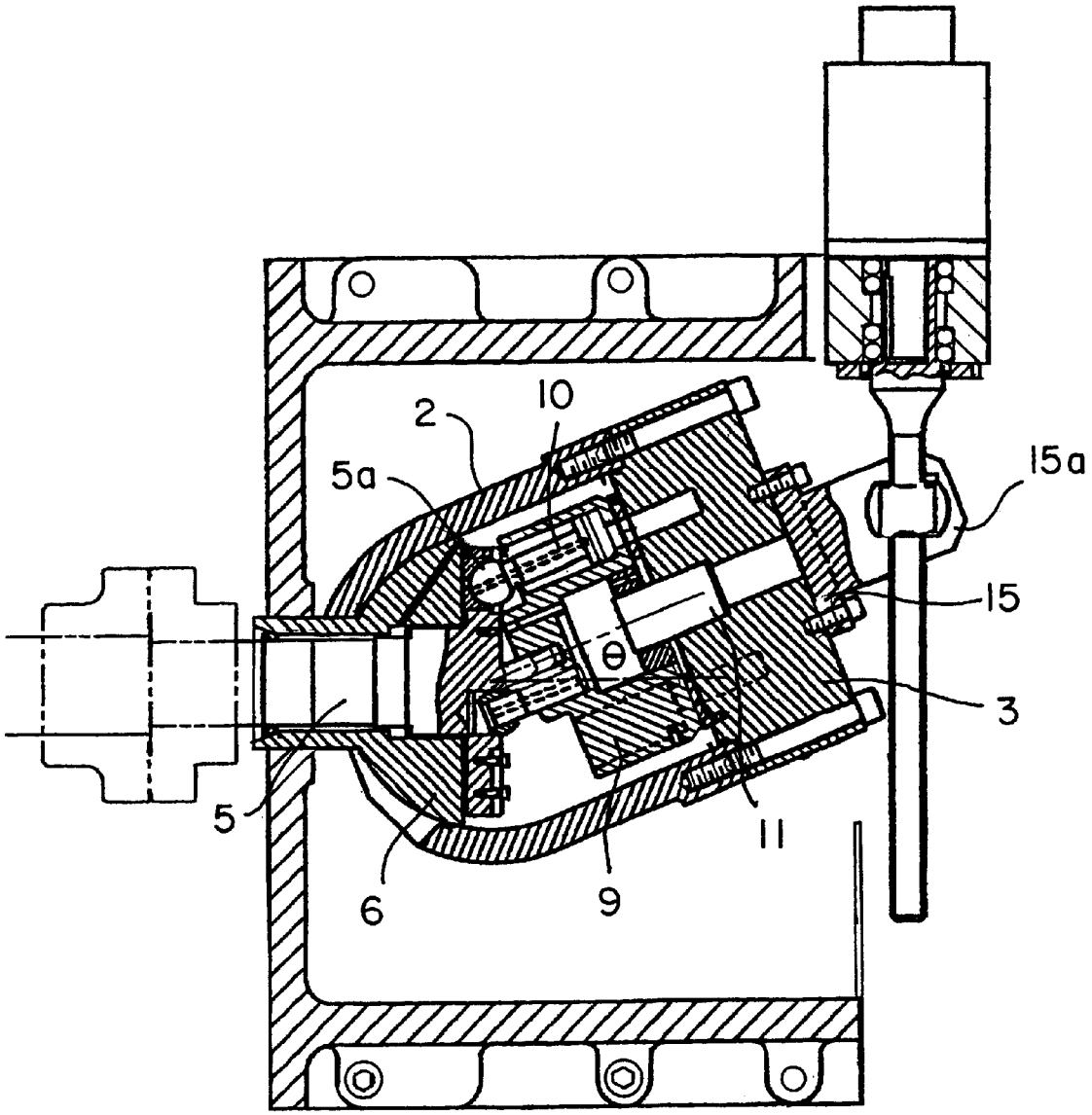
FIG. 4 is a view similar to FIG. 3 with in a tilted state.

Referring to FIG. 3 and FIG. 4, the end opening 2*a* of the housing 2 is formed as a slot that is perpendicular with the hydraulic intake/discharge tubes 14 to allow tilting in one direction around the pair of hydraulic intake/discharge tubes 14 shown in FIG. 1. The size of the slot determines the maximum tilting angle. Although a detailed description of the structure will be omitted, scaling members such as O-rings are disposed between the members used for the communicating paths 2*e*, 3*a* to prevent leakage of the active oil. Oil-feeding paths are also formed to supply lubricating oil to the bearings and sliding surfaces along the perimeters of the shaft support cylinder 6 and the intake/discharge path tubes 14.

Referring to FIG. 3, a plate 15 is screwed to the central section of the housing 2. The plate 15 includes a traction lever attachment mechanism 15*a*. The plate 15 can have any shape and can be formed in a "T" shape or an "L" shape.

In the structure described above, the input/output shafts 5 of the pump/motor 1 can be, for example, connected to a rotation load device, and a fixed positional relationship is maintained. The pair of intake/discharge tubes 14 are fixed to the pump/motor attachment device and are connected to tubing from a hydraulic pressure generating device or the like.

Referring to FIG. 1 and FIG. 3, if the tilt angle theta of the cylinder block 9 is set to zero and the input/output shafts 5 are oriented in a straight line, the pistons 10 will not be activated even if the input/output shafts 5 are rotated or if hydraulic pressure is applied to the cylinder bores 9*a*. Thus, no output will be obtained even if rotation force is applied to the input/output shafts and hydraulic pressure is supplied to the cylinder bores. If the traction lever attachment mechanism 15*a* is manually or dynamically pulled in one direction, the housing will pivot around the intake/discharge tubes 14, and the tilt angle theta will be the maximum angle when there is abutment with one edge of the opening 2*a*. The tilt angle can be adjusted freely as necessary in the range between 0 and a maximum angle.

Referring to FIG. 4, when the input/output shafts 5 are rotated from the state shown, the rotation force is transferred to the cylinder block 9 via the drive pin 13, causing the cylinder block to rotate along the inner side surface of the side cover 3. In other words, as seen from the input/output shafts 5, the cylinder block 9 rotates, leading to conversion to reciprocating movements in the pistons 10. If the rotation is forward rotation, discharge pressure is obtained from one of the hydraulic intake/discharge tubes 14, and if the tilting angle theta is tilted in the opposite direction and reverse rotation is performed, discharge pressure is obtained from the other hydraulic intake/discharge tube 14. When hydraulic pressure is applied in the piston pump/motor device 4, a high thrust force is generated at the pistons 10. However, this pressure is received by the housing. 2 in a distributed manner due to the spherical surface contact with the shaft support cylinder 6, which is formed with a spherical outer surface. This provides an extremely stable pivoting mechanism which does not require the housing to be formed especially thick or rigid.

The housing 2 can be tilted in one direction around the pair of hydraulic intake/discharge tubes 14, which are fixed at the lines connecting the center points of the spherical sections 10*a* of the pistons 10. Since the rotation axis lies on the same line, the traction lever, which is attached at a position away from the tilting position, can be operated easily with a small pull. The tilting of the cylinder block 9 is performed by rotating the housing 2 around the intake/discharge tubes, 14. This allows rotation to be performed without any external force to the main elements of the pump/motor device, and provides a highly reliable pump/motor device that can be kept tightly sealed.

The operations described above are for variable displacement piston pumps, but the same applies for variable displacement piston motors in which hydraulic pressure is supplied from the hydraulic intake/discharge tubes 14 and rotation is obtained from the input/output shafts 5.

Referring to FIG. 5 and FIG. 6, there is shown another embodiment of the traction lever device. This device includes: a threaded shaft 16; an engagement piece 17*a* of a plate 17 fixed on one end to the side cover 3; a pivot pin 18 rotatably disposed on the engagement piece and meshing with the threaded shaft 16; a boss 21 rotatably supporting the base of the threaded shaft 16 and supported to a fixed frame 19 via a pivot pin 20; and a servo motor 22 providing rotation force to an output shaft 22*a* connected to the shaft 16.

In this device, forward and reverse rotations of the servo motor cause the threaded shaft 16 to rotate. The action of the threads pulls the housing 2, causing it to tilt. With this structure. the pivot pins 18, 20 absorb the bending stress generated when the housing is tilted. This provides smooth movements, allows speedy operations even with low force, and also conserves energy.

With the present invention, input/output shafts maintaining a fixed relationship are supported by a shaft support cylinder having a spherical outer perimeter. The other end of the housing is pivotably supported by the shaft supporting cylinder. The housing can be freely tilted in one direction around hydraulic intake/discharge tubes fixed at a position along lines connecting the centers of the spherical heads of the pistons. This provides a variable displacement piston pump/motor with a simple structure and stable operations.

In the present invention, a traction lever attachment mechanism is attached at the axial center of the outer side surface of the side cover. The tilt angle of the housing is changed by pulling in one direction. This traction lever attachment mechanism is positioned away from the tilting axis, thus allowing tilting to be performed with a small pulling force.

In the present invention, the traction lever is formed from a threaded shaft meshed with a pivot pin rotatably disposed on a plate fixed to the side cover. The shaft is controlled by externally applied forward/reverse rotation. This allows a small driving force to be used to reliably approach a required tilting angle.

In the present invention, the base of the threaded shaft is rotatably supported by a boss that is pivotably supported by a pivot pin. Thus, even if an excessive bending torque is generated when the threaded shaft is being rotated, smooth operations are possible, providing more automation.

In the present invention, rotation force to the threaded shaft is provided by a servo motor. This allows the present invention to be easily used with CNC.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In a variable displacement piston pump/motor disposed in a cylindrical housing, said cylindrical housing having an opening at one end, said cylindrical housing mounting input/output shafts passing through said cylindrical housing one end opening, an opposite end of said cylindrical housing being covered by a side cover, a cylinder block, an end of said cylinder block facing said shafts, an opposite end of said cylinder block facing an inner surface of said side cover with a valve plate intervening said cylinder block opposite end and said side cover inner surface, a drive pin interposed between and connecting said cylinder block and said shafts, a plurality of concentrically arrayed pistons disposed about said drive pin for providing a rotation output or hydraulic discharge force, said pistons including spherical heads pivotably supported by an end surface of said shaft, and said input/output shaft being pivotably supported in a shaft support cylinder, the shaft support cylinder having a spherical outer surface at an end thereof engaging with a spherical inner surface of the cylindrical housing at said one end of said cylindrical housing, said housing being tiltable on said support cylinder to thereby be pivotable about hydraulic intake/discharge path-forming tubes fixed on lines connecting centers of the spherical heads of said pistons.

2. A variable displacement piston pump/motor as described in claim 1, wherein a traction lever mechanism is disposed at an axis center section of an outer side surface of said side cover, pulling said tractor lever attachment mechanism in each of two opposite directions applying a corresponding tilting angle direction to said housing.

3. A variable displacement piston/motor as described in claim 2, wherein said traction lever mechanism includes a threaded shaft meshed with a pivot pin rotatably disposed on a plate fixed to said side cover, said traction lever mechanism being controlled by externally applied forward and reverse rotation.

4. A variable displacement pump/motor as described in claim 3, wherein a base of said threaded shaft is rotatably supported by a boss that is pivotably mounted by a pivot pin.

5. A variable displacement pump/motor as described in claim 3, wherein a servo motor applies rotation force to said threaded shaft.

* * * * *